United States Patent [19]

Jachowski

[11] 3,935,549

[45] Jan. 27, 1976

[54] FERRITE CIRCULATOR

[75] Inventor: Ronald E. Jachowski, Scottsdale, Ariz.

[73] Assignee: Decibel Products, Inc., Dallas, Tex.

[22] Filed: Aug. 12, 1974

[21] Appl. No.: 496,903

[52] U.S. Cl. ..... 333/1.1; 333/24.2

[51] Int. Cl.[2] ..... H01P 1/38; H01P 1/36

[58] Field of Search ..... 333/1.1, 24.2; 343/175, 343/176, 853; 336/110, 133

[56] References Cited

UNITED STATES PATENTS

| | | | |
|---|---|---|---|
| 3,085,212 | 4/1963 | Clark et al. | 333/1.1 |
| 3,095,546 | 6/1963 | Ayres et al. | 333/24.2 |
| 3,316,505 | 4/1967 | Geiszler | 333/1.1 |
| 3,414,846 | 12/1968 | Caswell | 333/24.2 |
| 3,614,670 | 10/1971 | Wilson | 333/1.1 |
| 3,725,823 | 4/1973 | Miura et al. | 333/1.1 |

*Primary Examiner*—Paul L. Gensler
*Attorney, Agent, or Firm*—LeBlanc & Shur

[57] ABSTRACT

Disclosed is an improved ferrite circulator particularly adapted for use as an isolator in VHF and UHF transmission systems. It comprises a pair of relatively thick ground plates to which are attached three or more equally spaced coaxial connectors forming circulator ports. A pair of elongated magnetic members extend between the ground plates from opposite sides of the circulator junction to a location between the ground plates remote from the junction. A resilient permanent magnet is movable between the magnetic members at the remote location to provide simple and rapid tuning by adjustment of the permanent magnet field across the junction.

17 Claims, 5 Drawing Figures

FERRITE CIRCULATOR

This invention relates to improvements in ferrite devices and more particularly to circulators of the strip transmission line junction type. This class of circulator makes use of ferrite elements at the junction of three or more transmission lines.

Ferrite circulators are well known and have been made for several years for the microwave frequency range. The circulator is basically a three or more port non-reciprocal device consisting of ferrite material, magnets and three or more short lengths of transmission line terminated at a common junction. For a three port device, power entering port 1 of the circulator is "rotated" and emerges at port 2. Power entering port 2 emerges at port 3 and power entering port 3 emerges at port 1. In VHF and UHF applications, the circulator is virtually always used as an isolator, that is, one port is terminated with a fixed load, such as a 50 Ohm load resistor.

In the past, ferrite circulators have in general been constructed so as to have the magnets providing the DC magnetic field located on a common axis of the ferrite material and the center of the junction of the strip transmission lines. The magnet located in this manner must of necessity be large in size, difficult to adjust and located directly in the path where the heat generated by the losses in the ferrite must travel to be dispersed in the mounting surface.

These difficulties are overcome by the device of the present invention which provides a ferrite circulator with a novel adjustable permanent magnet circuit. In the present invention, the permanent magnet is located remote from the ferrite discs so that heat dissipation from the ferrite material has minimum adverse affect on the magnetic properties of the permanent magnet. Furthermore, the magnet of the present invention is movable or adjustable relative to the other components of the magnetic circuit so that the circulator may be tuned in a very simple and efficient manner to the desired operating frequency. In the preferred embodiment, the permanent magnet is preferably formed from resilient material such as natural or synthetic rubber throughout which magnetic particle are dispersed. The resilient permanent magnet is made with a slightly greater thickness than the space between the fixed elements of the magnetic circuit so that it is slightly compressed and held in place when moved to the necessary position for exact tuning of the circulator. This arrangement eliminates the need for any spacers or any milling or otherwise working of the permanent magnet material which might have an adverse effect on its magnetic properties.

It is therefore one object of the present invention to provide a ferrite circulator having a magnetic circuit requiring significantly smaller magnets, one which is easily adjustable, and one in which the permanent magnet is out of the heat path through which the heat generated in the ferrite material is dissipated.

Another object of the present invention is to provide a ferrite circulator which is compact in size and simple in construction.

Another object of the present invention is to provide a ferrite device which has more stable performance characteristics over a wide temperature range because of the smaller size magnets required for operation. The magnetic strength (Gauss) of the magnet varies with temperature. While the percentage change in large and small magnets is the same, the absolute change in the magnetic field strength (Gauss) is less in smaller magnets.

Another object of the present invention is to provide a ferrite device such as a circulator with a magnetic circuit having a minimum thickness thus allowing the device to be mounted in areas not otherwise possible.

These and further objects and advantages of the invention will be more apparent upon reference to the following specification, claims and appended drawings wherein:

Figure 1:
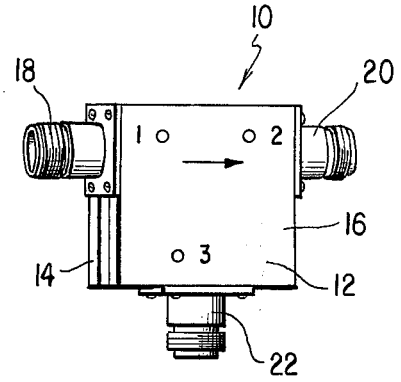
FIG. 1 is a perspective view of a ferrite circulator constructed in accordance with the present invention.

Referring to the drawings, the novel circulator of the present invention is generally indicated at 10 in FIG. 1. It comprises a housing 12 formed by a pair of spaced parallel plates 14 and 16 to which are joined in this case three coaxial connectors 18, 20 and 22. Each of the connectors defines a port with the connector 18 labeled port 1, connector 20 labeled port 2, and connector 22 labeled port 3.

Figure 2:
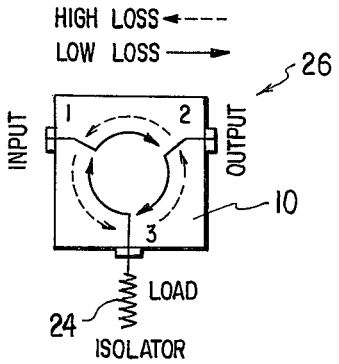
FIG. 2 is a diagrammatic showing of an isolator in accordance with the present invention incorporating the circulator of FIG. 1.

Circulator 10 is a three port non-reciprocal device and is indicated diagrammatically in FIG. 2. Power entering port 1 (connector 18) is "rotated" and emerges at port 2 (connector 20). Power entering port 2 emerges at port 3 (connector 22) and power entering port 3 emerges at port 1. Insertion loss in the forward direction (port 1 to 2, etc.), is approximately 0.5 db while the loss in the opposite direction (port 2 to port 1, etc.) is 20 to 25 db or more. In VHF and UHF applications, the circulator 10 is virtually always used as an isolator and for this reason port 3 in FIG. 2 is shown as terminated with a 50 Ohm load resistor 24. The overall isolator formed by circulator 10 and the port 3 load resistor 24 is indicated by the reference numeral 26.

Figure 3:
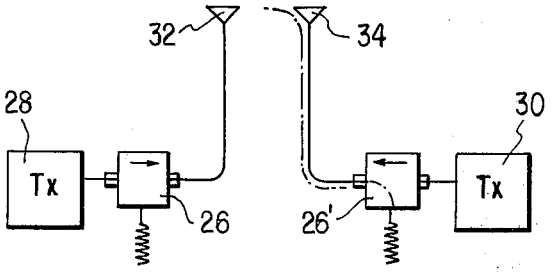
FIG. 3 is a simple block diagram showing a transmission system using two isolators constructed in accordance with FIGS. 1 and 2.

The isolator 26 of FIG. 2 is a most effective solution to transmitter intermodulation — short of relocating transmitters — when the frequency separation between the desired and undesired signal is extremely close. This is illustrated in FIG. 3 where two transmitters close in carrier frequency and labeled 28 and 30 respectively are connected to adjacent antennas 32 and 34. Transmitter 28 is shown in FIG. 3 connected to antenna 32 by way of isolator 26 and transmitter 30 is shown as connected to antenna 34 by way of a second identical isolator labeled 26' in FIG. 3.

Because of its unusual characteristics and broad bandwidth, the isolator 26 is equally suitable for use when the frequency separation is anywhere from 0 KHz to 4 MHz. When installed between the antenna and transmitter, the isolator 26 acts like an RF diode. It passes the transmitter power from its input to the output with very little loss but provides 20 to 25 db attenuation to the passage of a signal in the opposite direction. Any energy entering the port 2 output, such as reflected transmitter power from the antenna, or energy induced in the antenna by another transmitter, is passed to the load resistor at port 3 and absorbed. The load resistor 24 must exactly match the impedance of the isolator to prevent energy from being reflected from port 3 to the input port, thereby reducing isolation between the input and output. In some instances, an isolator can itself produce second harmonic spurious energy and for this reason it may be desirable to use a low pass filter between the respective isolator and antenna in each transmitter circuit of FIG. 3.

Figure 4:
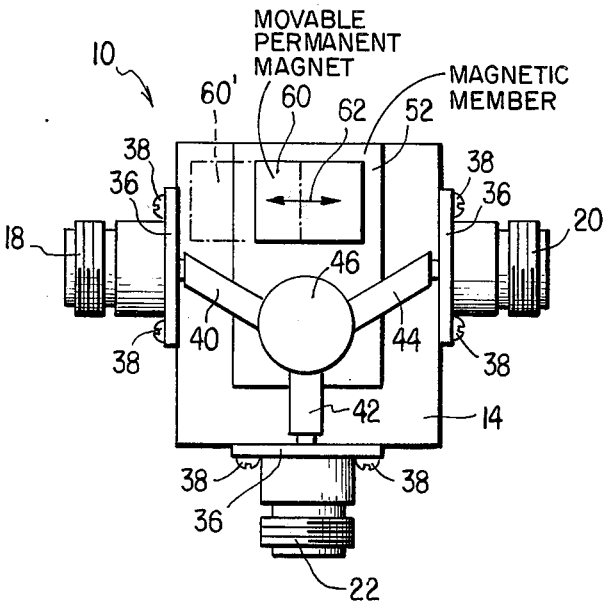
FIG. 4 is a plan view of the circulator of FIG. 1 showing the adjustable nature of the permanent magnet.
Figure 5:
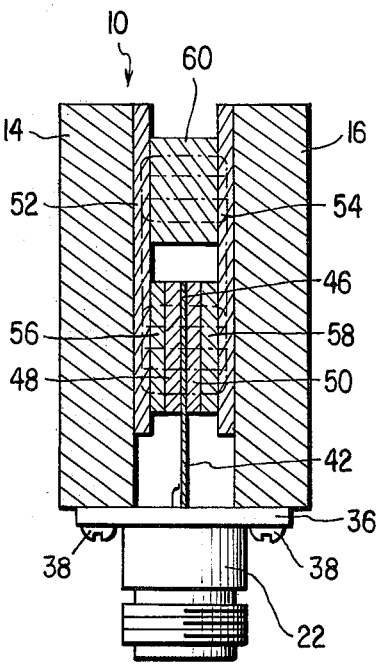
FIG. 5 is a cross section through the circulator of FIG. 4.

FIG. 4 is a plan view of the circulator 10 of FIG. 1 with portions removed to show the interior structure. FIG. 5 is a cross section through the complete circulator. It comprises the three coaxial connectors 18, 20 and 22, each having a flange 36 secured to the spaced plates 14 and 16 by four screws 38. Spaced plates 14 and 16 are electrically conductive and form the ground planes for the circulator as well as acting as a housing for the interior structure.

Each of the inner conductors of the coaxial connectors is connected to a respective flat strip 40, 42, and 44 forming a balance Y-circulator at the disc shaped central conductor junction 46.

Located on each side of the conductive disc or junction 46 is a similar sized ferrite disc as shown at 48 and 50 in FIG. 5. These are separated from elongated magnetic members 52 and 54 by respective disc shaped magnetic pole pieces 56 and 58.

The magnetic field indicated by the dashed lines in FIG. 5 is generated by a permanent magnet 60 polarized perpendicular to the plane of the drawing in FIG. 4 and movable between magnetic members 52 and 54 as indicated by the double-ended arrow 62. The magnet may be moved for example from the solid line position illustrated in FIG. 4 to the dashed line position illustrated at 60'. The magnet is preferably of rectangular cross section with a thickness slightly greater than the spacing between the adjacent surfaces of the magnetic members 52 and 54 so that the permanent magnet 60 is slightly compressed when positioned between members 52 and 54. To this end, the magnet is preferably formed of a resilient material such as natural or synthetic rubber throughout which are dispersed magnetic particles so that magnet 60 takes the form of a resilient permanent magnet. Rubber magnets of this type are readily available and by way of example only are sold commercially by the 3-M Corporation.

In FIGS. 4 and 5, the ferrite discs 48 and 50 are biased by the magnetic field existing between the pole pieces 56 and 58. The magnetic field from the pole pieces is derived from the permanent magnet 60 by way of magnetic members 52 and 54. As shown in FIG. 4, the magnetic circuit is easily adjusted by sliding the magnet 60 in the direction of the double-ended arrow 62 sufficiently so that the magnet is partially removed from between magnetic members 52 and 54. By positioning the permanent magnet so that more or less of it lies outside the space between magnetic members 52 and 54, the magnetic field to which the ferrite discs are subjected may be readily changed to tune the circulator to the desired operating frequency. The resiliency of the permanent magnet 60 insures that once properly positioned, it will remain in place and will not move under normal operating conditions.

It is apparent from the above that the present invention provides an improved ferrite circulator or improved ferrite isolator which is of simplified and relatively inexpensive construction. Important features of the invention include the provision of a movable permanent magnet and preferably one made from resilient magnetic material. The simple adjustment of the permanent magnet makes it possible to tune the circulator in minutes instead of hours as in previous constructions and eliminates the necessity for "hot tuning." Since heat tends to produce changes in the characteristics of magnetic material, it is an important feature of the invention that the permanent magnet is located away from those portions of the structure in which the heat generated by the ferrite discs is dissipated. The rubber magnets are relatively inexpensive and do not have to be milled or otherwise worked to an appropriate size as might otherwise tend to change the magnetic characteristics of the magnet.

The invention may be embodied in other specific forms without departing from the spirit or essential characteristics thereof. The present embodiment is, therefore, to be considered in all respects as illustrative and not restrictive, the scope of the invention being indicated by the appended claims rather than by the foregoing description, and all changes which come within the meaning and range of equivalency are therefore intended to be embraced therein.

What is claimed and desired to be secured by United States Letters Patent is:

1. A circulator comprising a pair of spaced parallel electrically conductive plates forming outer conductors for said circulator, a plurality of inner conductors forming a central junction and extending outwardly from said junction between said plates, a plurality of electrical connectors forming ports joined to said plates and respective inner conductors, a ferrite element between each side of said junction and the adjacent outer conductor, a pair of elongated magnetic members located on opposite sides of said junction between said plates and said respective ferrite elements, said members extending to a location remote from said junction, and a permanent magnet between said members at said location, said permanent magnet being slidably mounted between said members for manual movement between said members for manual movement between a first position in which a greater portion of said magnet lies between said magnetic members and a second position wherein a lesser portion of said magnet lies between said members.

2. A circulator according to claim 1 wherein said magnet is polarized in a direction perpendicular to the planes of said members.

3. A circulator according to claim 1 wherein said elongated magnetic members are provided with a pair of magnetic pole pieces on opposite sides of said ferrite elements.

4. A circulator according to claim 1 wherein said permanent magnet is resilient.

5. A circulator according to claim 4 wherein said magnet is slightly compressed between said members.

6. An isolator according to claim 1 including a fixed load impedance coupled to one of said ports.

7. An isolator according to claim 6 wherein said load impedance is matched to the impedance of said circulator.

8. A circulator according to claim 1 wherein said ferrite elements comprise a pair of ferrite discs.

9. A circulator according to claim 8 wherein said junction is of circulator configuration having at least approximately the same diameter as said ferrite discs.

10. A circulator according to claim 9 wherein said ports are formed by coaxial connectors.

11. A circulator according to claim 10 wherein said coaxial connectors are joined to said junction by strip lines.

12. A circulator according to claim 11 wherein said coaxial connectors include flanges, and means securing said flanges to said parallel ground plates.

13. A circulator according to claim 1 wherein said ports are spaced equal angles about the periphery of said ground plates.

14. A circulator according to claim 13 wherein said ports are three in number.

15. An isolator according to claim 14 wherein one of said ports is terminated with a fixed load resistor.

16. A transmission system comprising a pair of circulators according to claim 1, a fixed load impedance terminating one of the ports of each of said circulators, a pair of transmitters and antennas, second and third ports of one of said circulators coupling one of said transmitters to one of said antennas, second and third ports of the other of said circulators coupling the other of said transmitters to the other of said antennas.

17. A transmission system according to claim 16 wherein said antennas are in close proximity, and said transmitters produce signals that are close in frequency.

* * * * *